United States Patent [19]

Heintzmann et al.

[11] 4,332,512

[45] Jun. 1, 1982

[54] ARRANGEMENT FOR ERECTING COLUMNAR SUPPORTING ELEMENTS FOR UNDERGROUND EXCAVATIONS

[75] Inventors: Peter Heintzmann, Bochum; Manfred Koppers, Duisburg; Karlheinz Bohnes, Bochum, all of Fed. Rep. of Germany

[73] Assignee: Bochumer Eisenhuette Heintzmann GmbH & Co., Bochum, Fed. Rep. of Germany

[21] Appl. No.: 145,059

[22] Filed: Apr. 30, 1980

[30] Foreign Application Priority Data

May 22, 1979 [DE] Fed. Rep. of Germany ..... 2920645
May 22, 1979 [DE] Fed. Rep. of Germany ..... 2920659

[51] Int. Cl.[3] ..... E21D 15/18; E21D 15/22

[52] U.S. Cl. ..... 405/290; 248/356; 405/288; 249/157

[58] Field of Search ..... 405/288, 290; 248/356; 249/143, 170, 163, 167, 155, 157

[56] References Cited

U.S. PATENT DOCUMENTS

| | | | |
|---|---|---|---|
| 1,197,483 | 9/1916 | Hauser | 249/143 |
| 1,201,613 | 10/1916 | Novy | 249/157 X |
| 1,300,393 | 5/1919 | Hodges | 249/157 X |
| 1,627,754 | 5/1927 | Townsend | 249/170 X |
| 1,875,977 | 9/1932 | Beckwith | 248/356 |
| 4,185,940 | 1/1980 | Spies | 405/288 |
| 4,249,837 | 2/1981 | Spies | 405/290 |

*Primary Examiner*—Dennis L. Taylor
*Attorney, Agent, or Firm*—Michael J. Striker

[57] ABSTRACT

An arrangement for erecting a columnar supporting element of a hardenable flowable material, for a roof of an underground excavation, has a hollow casing for filling with a hardenable flowable material and is composed of two telescopable casing portions each composed of two open-end semi-circular sections, an element for holding the upper casing portion in contact with the roof of an underground excavation and arranged adjacent to the casing, and elements for connecting the semi-circular sections of at least the lower prop casing portions with one another so as to be pivotable about a longitudinal pivot axis which is parallel to the longitudinal axis of the prop casing, and locking the same with one another.

29 Claims, 7 Drawing Figures

ARRANGEMENT FOR ERECTING COLUMNAR SUPPORTING ELEMENTS FOR UNDERGROUND EXCAVATIONS

The present invention relates to an arrangement for erecting columnar supporting elements of a hardenable flowable material, for example concrete, for underground excavations.

An arrangement for erecting a supporting element of concrete directly in situ underground is known, for example, from the German Offenlegungsschrift No. 2847906. This arrangement is composed of two telescopable prop casing portions with closed opposite ends. The prop casing is filled with concrete at a location where a supporting column must be erected, while the upper prop casing portion moves upwardly, being guided in the lower prop casing portion and having a head face closed except for a small ventilating opening, until it abuts against the roof of the excavation. After the abutment, the supply of concrete is interrupted, and the filling process is thus terminated.

The material of the prop casing is non-metallic. It is based, for example, on cardboard or synthetic plastic and possess only such strength that the concrete which fills the casing can be held in predetermined form until the concrete hardens. Since the hardening of concrete takes several hours, a hydraulically operated cylinder-and-piston unit is provided for maintaining the abutment of the upper prop casing portion against the roof of the excavation. The cylinder-and-piston unit has relatively movable parts which are connected with the upper end of the upper casing portion and the lower end of the lower casing portion.

The above-described arrangement has a disadvantage connected with the long hardening time of the concrete, in that the concrete column can perform its supporting functions only after elapse of this hardening time. Moreover, neither prop casing nor the hydraulically operated cylinder-and-piston unit arranged outside of the prop casing, can apply an effective positive supporting force to the rock during the time of hardening. The casing acts exclusively as a means to confine the concrete, so that during the hardening time of the concrete the ceiling is unsupported. These disadvantages are not tolerable in the operating conditions of underground mines. Moreover, the known prop casing is an article which cannot be reused.

SUMMARY OF THE INVENTION

Accordingly, it is an object of the present invention to provide an arrangement for erecting a columnar supporting element for an underground excavation, which avoids the disadvantages of the prior art.

More particularly, it is an object of the present invention to provide an arrangement for erecting a columnar supporting element of a hardenable flowable material for a roof of an underground excavation, which arrangement is not expensive to manufacture, provides for a fast support of rock, and fits in variable distances between the roof and sole.

In keeping with these objects and with others which will become apparent hereinafter, one feature of the present invention resides, briefly stated, in an arrangement for erecting a supporting element of the hardenable flowable material for a roof of an underground excavation, which has a hollow casing adaped to be filled with a hardenable, flowable material and having upper and lower axial casing portions which are telescopable in an axial direction and each composed of two open-ended semi-circular sections, longitudinally variable means arranged adjacent the prop casing and operative for holding the upper casing portion in contact with the roof of an underground excavation, and means for connecting the semi-circular sections of at least the lower casing portion with one another so as to be pivotable about a longitudinal pivot axis which is parallel to a longitudinal axis of the prop casing, and locking the same with one another.

The important feature of the invention is the functional combination of a frequently reusable prop casing for a columnar support to be erected with holding means located adjacent to the prop casing. More specifically, the holding means not only serves for holding the upper casing portion against the roof of the excavation during the time required for the concrete filling to harden, but also guarantees that when the prop casing is erected in abutment into the roof and the sole, the desired supporting force for the roof is provided and is maintained during the hardening time of the concrete.

As mentioned above, the upper and lower portions of the prop casing are each composed of two semi-circular sections of which the semi-circular sections of at least the lower prop casing portion are connected to be pivotable about a longitudinal pivot axis which is parallel to a longitudinal axis of the prop casing and of course are locked with one another so as to withstand the pressure of the filling substance, for example, the concrete. The semi-circular sections of the upper prop casing portion may, in principle, not be pivotally connected with one another, inasmuch as they are vertically guided in the lower casing portion and are exially displaceable by the holding means. However, it is also possible in accordance with the invention that the semi-circular sections of the upper prop casing, similarly to those of the lower prop casing, may be connected pivotally about a vertical pivot axis which is parallel to the longitudinal axis of the prop casing.

The construction of the prop casing of two pivotally connected semi-circular portions and the releasable arrangement of the holding means allow to build in a simple way a casing which acts to some extent as a carrying prop, and a supporting column, with a few manipulations. When the supporting column, for example, of concrete, is erected, the casings can be removed and again built at another location.

It can be appreciated that the great advantage of the inventive arrangement resides, on the one hand, in the reusability of the casing for the supporting columns and, on the other hand, in that the holding means can provide for the required supporting force and can maintain the same during the entire time of hardening of the substance in the prop housing. When the substance in the prop casing is hardened, the holding means is released, the prop casing is removed from the produced supporting column, and the entire arrangement, if necessary after cleaning of the prop casing, can be used again.

In accordance with another advantageous feature of the present invention, the holding means engaged with the upper prop casing portion is resiliantly yieldable and supported on a pit prop extending between the roof and the sole of the excavation adjacent to the prop casing. In such a construction a functional connection is attained of the frequently reusable prop casing with a pit prop which is arranged near the prop casing and may be hydraulically operated. The pit prop takes the task, during the time of hardening of the substance filling the casing, of generating the required supporting force for the rock and thereby of reliably supporting the roof. The pit prop also performs the functions to reliably bring the upper casing portion into contact with the roof when because of local unevenness, for example, breakage, height differences take place between the location where the pit prop extends and the location where the supporting column must be erected. For this purpose, a resiliently yieldable pressure member is arranged between the upper prop casing portion and the pit prop, the pressure member serving to move the upper casing portion into abutment against the roof while compensating for the height difference. Furthermore, the pit prop can simultaneously serve for pulling the upper casing portion out of the lower prop casing portion for erection purposes.

In accordance with still another feature of the present invention, the holding or pressing member is formed by a helical pressure spring located between a stationary shoulder and an axially movable sleeve of a pit prop, the sleeve engaging from below with a bracket of an annular collar of the upper housing portion. When the pit prop is tightened, the helical pressure spring abutting against the stationary shoulder performs the functions of holding the upper prop casing portion on the roof of the excavation via the sleeve and the bracket. The coupling of the casing with the pit prop simultaneously guarantees that the prop casings during the filling of the hardenable substance and during the hardening period remains at the location where the supporting column must be erected. No additional requirements are made to secure the casing for the supporting column. The sleeve which is axially movable on the pit prop can be releasably connected with the bracket engaging the prop casing below the annular collar. The helical pressure spring can also be freely movable on the periphery of the pit prop. In some cases, it can be surrounded by a protective jacket of a resistant and easily manipulatable material.

In accordance with yet another feature of the present invention, the bracket has a bracket section which engages the annular collar of the upper casing portion and is formed as a gripping clamp. A gripping clamp may have one pivot arm or two pivot arms. The gripping clamp fits in suitable manner on the outer periphery of the upper prop casing portion, while the respective pivotal part is connected with the adjacent part by a pin which engages in a respective coupling console on the gripping clamp. The gripping clamp together with the lockable semi-circular sections of the lower casing portion can serve for connecting the semi-circular sections of the upper casing portion and their axial guidance.

In accordance with a further advantageous feature of the present invention, the holding means is formed by two cylinder-and-piston units provided with mechanical springs and having cylinders which are located at two pit props arranged diametrically opposite relative to a longitudinal axis of the prop casing between the roof and sole, and piston rods abutting against a radially extending annular collar of the upper prop casing.

The provision of two pit props located at the opposite sides of the casing guarantees that the upper casing portion abuts against the roof of the excavation without tilting. The resiliently yieldable holding means in such a construction can compensate for some height differences between the pit props and the prop casing. The cylinder of the cylinder-and-piston unit can be easily fastened to the pit prop. The piston rods actuated by helical pressure springs or other suitable mechanical spring elements displace upwardly out of the cylinders and engage under the radially extending annular collar of the upper casing portion. In order to guarantee in this connection an unabjectionable uniform pressure on the upper casing portion against the roof, the annular collar may be provided at its lower side with recesses in which the end portion of the piston rod engages so as to be fixed in its position.

As a supplementary measure for effective support of the roof and for central abutment of the upper casing portion against the roof, it is provided in accordance with a further advantageous feature of the present invention that the pit prop supports on a common bottom plate having a central opening through which the lower prop casing portion extends. With such a construction, a miner can bring the pit prop and the prop casing in their relative positions exactly, without judging only by sight or feeling.

The inventive features are also attained when the pit prop having the extensible longitudinal portion, for example the telescopable prop, is placed so that the extensible portion extends toward the roof. However, in accordance with an advantageous feature of the present invention, the extensible longitudinal portion of the pit prop extends toward the roof. In such construction, the not-extensible longitudinal portion of the pit prop which can be loaded higher is more favorable for mounting the resiliently yieldable holding member with its holding parts including the transmission means.

In accordance with still a further advantageous feature of the present invention, the upper prop casing portion has a radially extending annular collar and a further radially extending annular collar vertically spaced from the first-mentioned radial collar. A filling opening for the hardenable material is located between the annular collars, and a releasably mounted ring also located between the collars rotates between a filling position in which a filling pipe of the ring coincides with the filling opening, and a closing position in which the ring closes the filling openings.

The ring sealingly arranged between the annular collars has the function of bringing the filling pipe in register with the filling opening of the upper casing portion. After the filling step, it is necessary to rotate the rings about the longitudinal axis so that the filling opening is sealed by the wall of the ring. In such a construction, no special closure for the filling opening or the filling pipe is required.

In order to make easier for a miner to bring the filling pipe in register with the filling opening, the ring is arrestable on the upper prop casing portion. For this purpose the ring can be provided with a pin radially displaceable against the spring force, the pin engaging in the filling position in a respective recess in the upper prop casing portion and thereby arresting the ring. After the filling step it is necessary to pull the pin against the spring force out of the recess and to rotate the ring in the circumferential direction, whereby the free end portion of the pin slides on the outer circumference of the upper casing portion. In this connection it is advantageous when the recess is arranged in the annular collar which is spaced from the upper end of the upper prop casing portion.

The pivotability of at least the semi-circular sections of the lower prop casing portion and in some cases of the semi-circular sections of the supper prop casing portion is guaranteed in accordance with the invention by the fact that the semi-circular sections of at least the lower prop casing portion are provided with hinge members. The hinge members are composed of bearing consoles extending radially from the outer periphery of the semi-circular portions, the bearing consoles being pierced by vertical pins. The vertical pins can act both as locking elements and as pivot pins.

In accordance with yet a further advantageous feature of the invention, the semi-circular sections of the upper prop casing portion and the semi-circular section of the lower prop casing portion may be pivotally connected with once another, and two hydraulically-operated cylinder-and-piston units are located at the opposite sides of the longitudinal axis of the prop casings, wherein cylinders of the units are hingedly connected by hinge collars with the lower prop casing portion and the piston rods of the units are clamped on the upper prop casing portion.

The essential feature of this embodiment is the connection of the frequently reusable prop casing with the two symmetrically arranged hydraulically-operated cylinder-and-piston units. After fillings of the prop casing with the hardenable material, during the time of the hardening, they not only perform the functions of holding the upper prop casing portion against the roof, but moreover guarantees that by tightening of the prop casing between the roof and the sole, the desired supporting force takes place in the roof and is maintained during the time of the hardening.

The construction of all prop casing portions with two pivotal connectible semi-circular sections and the releasable arrangement of the symmetrically located cylinder-and-piston units providing for an exactly central supporting force allows, in an advantageous manner, to erect the prop casing which to some extent serves as a self-carrying prop, at a predetermined location where the supporting column must be erected, and after the formation of the supporting column for example of concrete, to remove the casing and to erect the same at another location.

In accordance with an especially advantageous feature of the present invention, the semi-circular portions can be connected pivotally about an axle which is parallel to the longitudinal axis of the prop casing, and coupled with one another via a further axle which is also parallel to the longitudinal axis of the prop casings. These axles are advantageously supported by bearing ears mounted on the semi-circular sections. Vertical pins extend through the bearing ears, and perform the functions of both locking pins and pivot pins, in dependence upon which pin is withdrawn from the bearing ears for spreading the casing apart.

An additional advantageous feature of the present invention, is that the cylinder of the cylinder-and-piston unit and the piston rods are supported in glasses-like hinge collars which are secured in the longitudinal direction of the prop casing by groove-spring connection. Such hinge glasses provide for an unobjectionable symmetric positioning of the cylinder-and-piston units with the result that the tightening force generated by the cylinder-and-piston unit is centrally applied via the casing to the rock. The groove-spring connection not only guarantees the immovability in the longitudinal direction of the prop casing, but also insures that the miner performs clamping of the hinge collar on the casing in accordance with the predetermined marking so as to exclude a false manipulation.

The groove-spring connection may be constructed so that the outer surface of the prop casing and the inner surface of the hinge collar are provided with grooves which correspond to one another, and a spring is inserted in the grooves so as to lock the hinge collar with the prop casings. It is also possible that only one groove is provided in one of the adjacent surfaces, whereas in the other of the adjacent surfaces an annular bead is arranged which is complementary to the groove and extends, for example, radially inwardly.

Since with the aid of the cylinder-and-piston units the upper casing portion must be displaced upwardly and downwardly, the piston rods of the cylinder-and-piston units is mounted in the hinge colar in draw-resistant and pressure resistant manner.

In order to maintain the stroke of the cylinder-and-piston unit as small as possible and thereby to provide for the correspondence of the dimensions of the cylinder and piston unit located outwardly of the prop casing in the hinge collar with the underground structural conditions, a further advantageous feature of the present invention resides in that the outer surface of the upper prop casing portion has several axially spaced circular grooves. In such a construction the upper prop casing portion can be drawn out of the lower casing portion to such a distance that the total length of the casing approximately corresponds to the distance between the roof and the sole of the excavation. Thereafter the hinge collars for the cylinder-and-piston units are arranged, wherein the hinge collar for the piston rods sits above the lower casing portion and advantageously is coupled with the circumferential groove which has the smallest distance to the lower prop casing portion. The stroke of the cylinder-and-piston unit must be so selected as to bridge the remaining small distance between the upper side of the upper prop casing portion and the roof with consideration of possible breaks above the casing. When the break is greater, the displacement of the hinge collar for the piston rod and the coupling with another circumferential groove must be performed.

The operation of the upper casing portion can be performed in accordance with the invention in that the pistons of the cylinder-and-piston units are actuated by helical pressure springs accommodated in cylinder chambers located at the side of the piston rod. This makes simpler the construction of the cylinder-and-piston unit.

The actuation of the cylinder-and-piston units may be performed from a central pump via detachable conduits. Such a pump with a supply container may be displaceable. Further, in accordance with the advantageous feature of the present invention the supply container and the pump for the hydraulic working medium, as well as the control means for the cylinder-and-piston units are formed by the blocks and flanged on the hinge collar for the cylinder-and-piston units. A hand-operated operated pump may be advantageously utilized as the abovementioned pump. The supply container may be small inasmuch as only a small quantity of working medium in the piston space of the cylinder-and-piston unit is sufficient for tightening of the casing between the roof and the sole of the excavation. The flangeable unit allows easy interchangeability in the event of maintenance works or repair work, and guarantees that a compact construction is attained which can be narrowly grouped around the lower prop casing portion and advantageously corresponds to the conditions prevailing in the underground excavation, particularly in very narrow mines.

In accordance with an additional feature of the present invention, the roof end section of the upper prop casing portion is provided with two vertically spaced radially extending annular collars, a filling opening for the hardenable material located between the annular collars, and a rotary and arrestable closure provided with a filling pipe between these annular collars. The rotary closure sealingly arranged between the annular collars, for example in grooves, on the outer circumference of the upper prop casing portion, has the function of bringing the filling pipe in register with the filling opening of the upper prop casing portion. After this filling step, it is necessary to turn the closure about the longitudinal axis of the prop casing so that the filling opening is sealingly closed by the wall of the closure. In such a construction no special lock for the filling opening or for the filling pipe is needed. Instead of the above-mentioned closure, a ring can be utilized which can be fitted between the annular collars via hinge members.

The arresting of the closure member in the filling position may be performed in different ways. It is advantageous when in accordance with the invention the closure is arrested by a spring-actuated pin in the filling position. The closure is provided for this purposes with a pin which is radially displaceable against spring force, the pin engaging in the filling position in a respective recess in the upper prop casing portion and thereby securing the closure. After the filling step it is necessary to pull the pin out of the recess against the spring force and to rotate the closure in a circumferential direction of the upper casing portion, whereas the free end section of the pin slides over the outer surface of the upper casing portion.

The material of the prop casing must be sufficiently resistant so as to withstand the pressure of the hardened substance, for example concrete, on the one hand, and to guarantee the longest possible service life with the consideration to the underground practice in connection with the frequent displacements of the prop casing. Further, the material of the prop casing must correspond to the construction supporting force. It can amount to, for example, thirty tons, and be distributed over the both cylinder-and-piston units with respectively fifteen tons on each unit. In connection with this, the prop casing in accordance with the invention may be formed of metal, particularly of steel or metal alloys.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
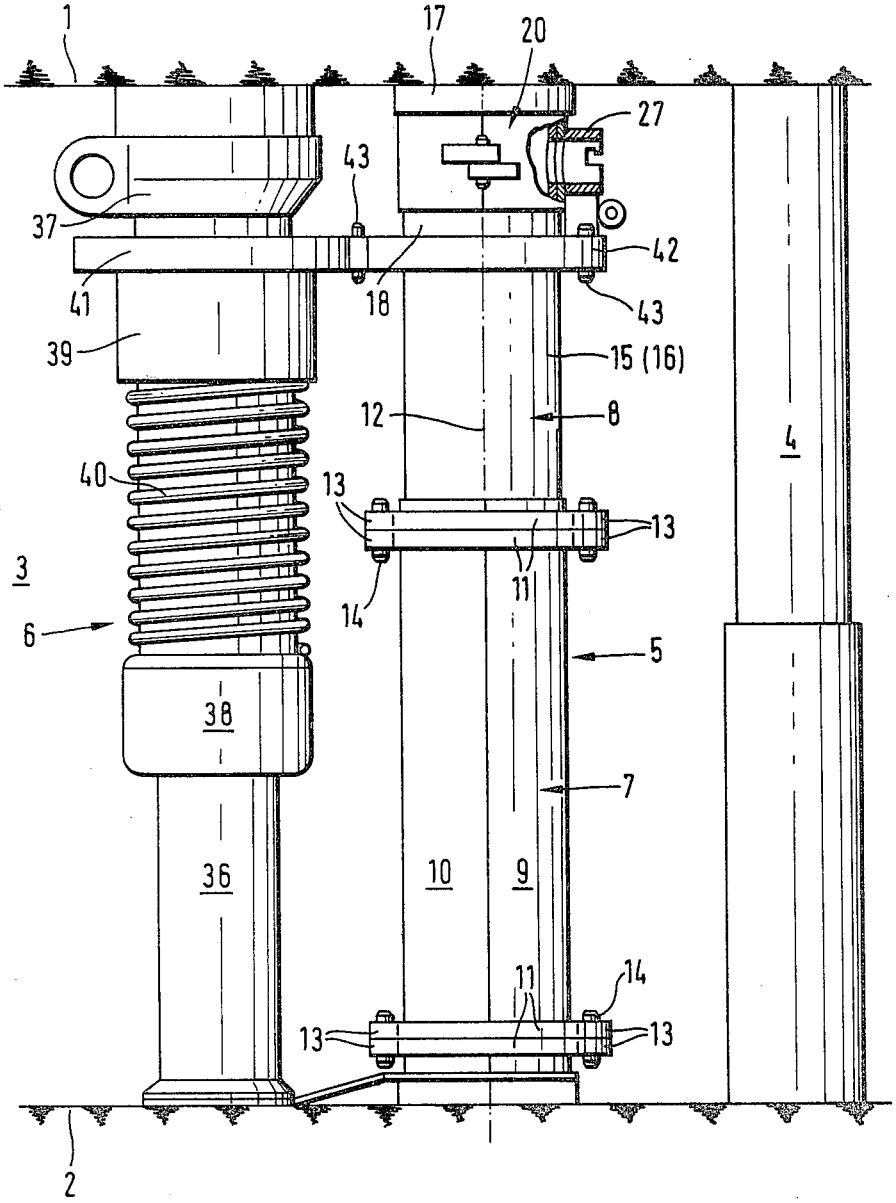
FIG. 1 is a side view showing an arrangement for erecting a columnar supporting element and a supporting element erected by the arrangement.

In FIG. 1 a mine gallery 3 is shown which has a roof identified by reference 1 and a sole identified by reference 2. A column-shaped supporting element 4 extends over the cross-section of the mine gallery and consists of concrete which in some cases is respectively reinforced. An arrangement for erecting the supporting concrete column 4 has a casing 5 and a pit prop 6 arranged immediately adjacent to the casing 5 between the sole 2 and the roof 1.

The casing 5 is composed in the embodiment shown in FIG. 1, of a lower casing portion 7 and an upper casing portion 8 which is telescopically movable in the lower prop casing portion 7. The lower prop casing portion 7 is formed by two semi-circular secitions 9 and 10 having cylindrical inner surfaces, the sections having open ends and together forming a tube. In the illustrated operational position, the semi-circular sections 9 and 10 are held together by hinge members 11 which are pivotal apart from and toward one another in a scissors-like manner. The hinge members 11 are arranged in upper and lower end sections of the lower prop casing 7. The hinge members 11 have hinge ears 13 which are located diametrically opposite relative to a longitudinal axis 12 of the prop casing 5. Pins 14 extend through the hinge ears 13 and serve both as pivot pins and as connecting pins.

Figure 2:
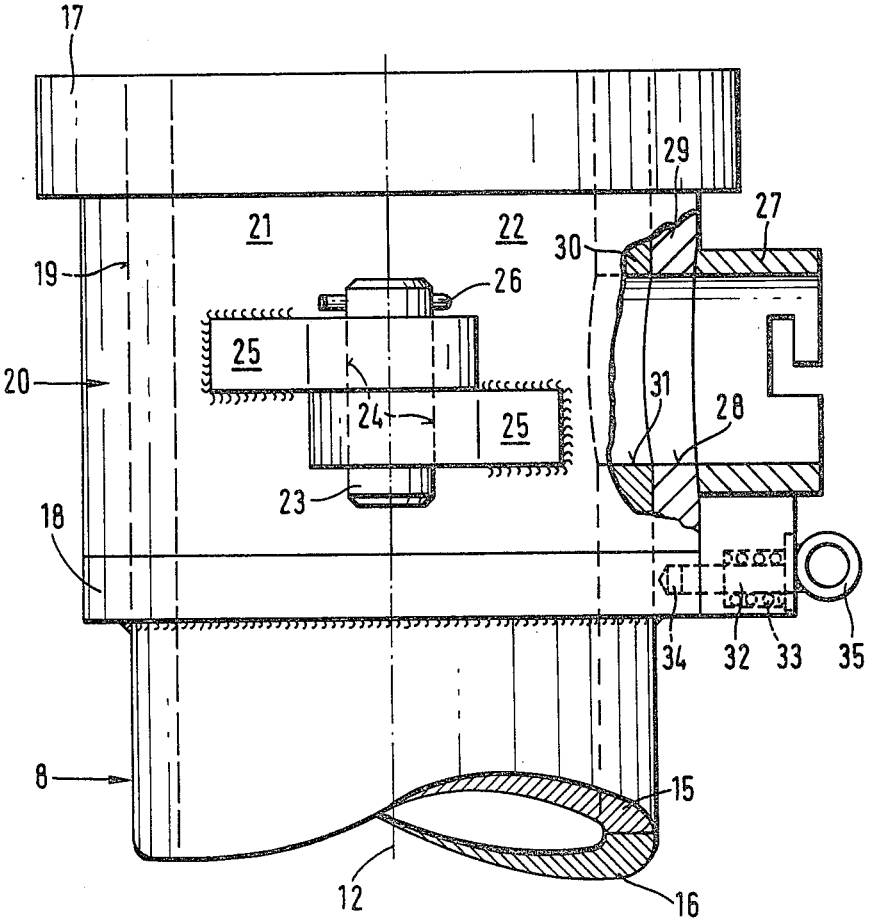
FIG. 2 is a partially sectioned enlarged view of a prop casing end portion facing toward the roof the excavation.

The upper prop casing portion 8 also includes, similarly to the lower prop casing portion 7, two semi-circular sections 15 and 16. The semi-circular sections 15 and 16 of the upper prop casing portion 8 are offset relative to the semi-circular sections 9 and 10 of the lower prop casing portion 7 by 90° in the horizontal plane. The semi-circular sections 15 and 16 have at their upper ends radially extending annular collar segments 17. The semi-circular sections 15 and 16 further have annular collar segments 18 spaced downwardly from the annular collar segment 17 so as to form a circumferential annular groove 19 therebetween, as shown in FIG. 2.

A closure collar 20 composed of two collar halves 21 and 22 engages in the annular groove 19. Both halves 21 and 22 are connected with one another by a pin 23 which extends through an opening 24 in a connecting console 25 of the halves 21 and 22. In order to prevent the dropping out of the pin 23, a transverse split pin 26 is provided. A tubular filling pipe 27 is arranged on the circumference of the half 22 coaxial to an opening 28 in a wall 29 of the half 22. The filling pipe 27 serves for connecting a concrete filling conduit. As can be further seen from FIGS. 1 and 2, a wall 30 of the semi-circular section 15 of the upper prop casing portion 8 has a hole 31 which can be brought in coaxial registry with the filling pipe 27.

In order to arrest the filling pipe in this position, a pin 32 is provided, the pin engaging in a recess 34 of the annular collar 18 under the action of the spring 33. An earlike handle 35 serves for withdrawing the pin 32 from the recess 34 against force of the spring 33, whereupon the closure collar 20 can rotate in the annular groove 19 between the annular collars 17 and 18 about the longitudinal axis 12 or the casing 5. Whereby, the opening 31 in the wall 30 of the semi-circular portion 15 is closed by the wall 29 of the half 22.

The pit prop 6 extending adjacent to the casing 5 between the roof 1 and the sole 2 is hydraulically actuated. Its extensible longitudinal portion 36 supports on the sole 2 and the non-extensible longitudinal portion 37 supports on the roof 1. A helical pressure spring 40 is arranged between a stationary shoulder 38 of the not extensible longitudinal portion 37 and a sleeve 39 axially movable on the not extensible longitudinal portion 37. The helical pressure spring 40 acts via the sleeve 39 and a bracket 41 connected with the sleeve 39 onto the upper casing portion 8 so as to press the latter against the roof 1. For this purpose, the bracket 41 has a collar 42 which surrounds the upper prop casing portion 8 and engages the annular collar 18 from below. The collar 42 is releasably connected via a pin 43.

Figure 3:
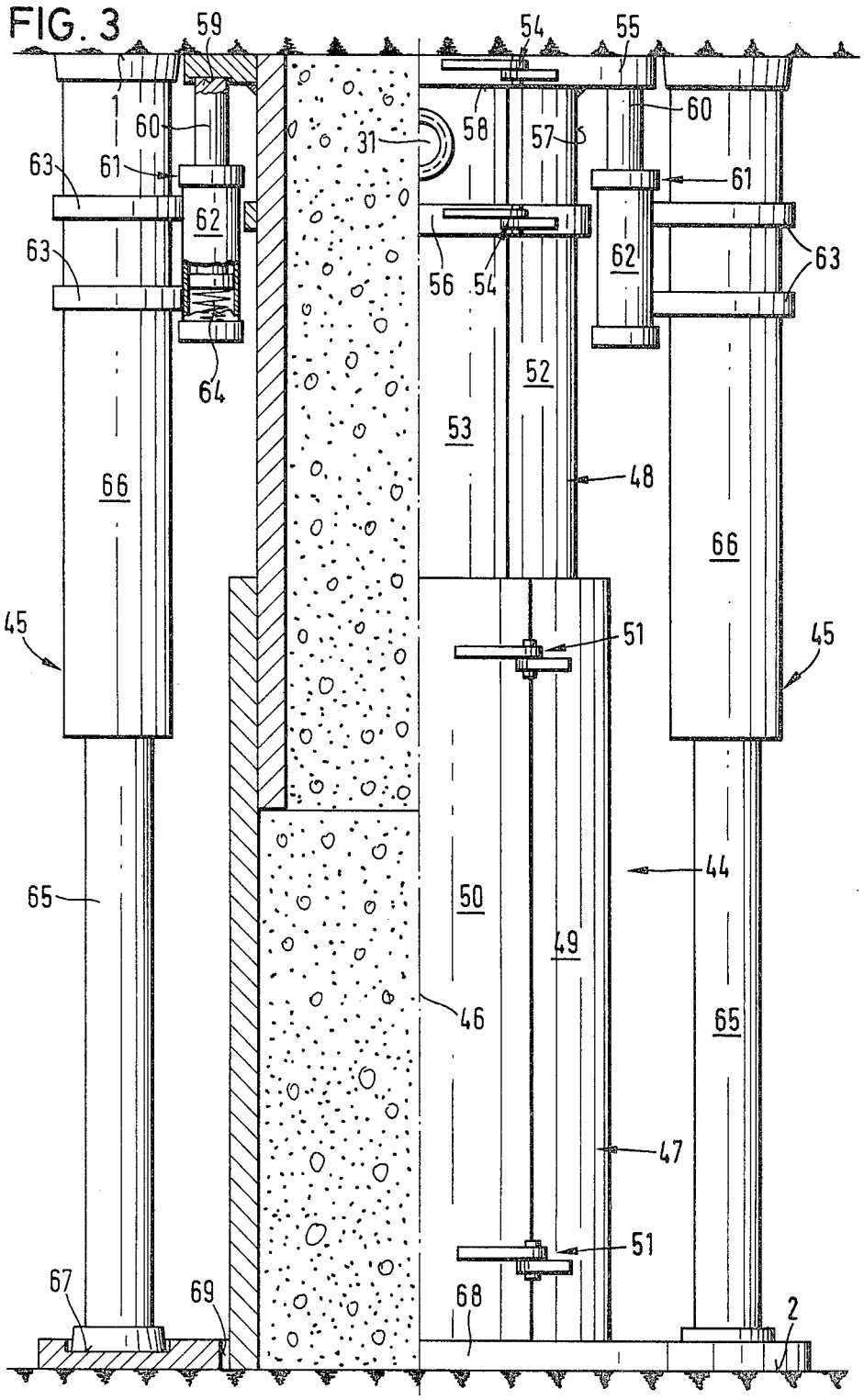
FIG. 3 is a partially sectioned side view of an arrangement for erecting a columnar supporting element, in accordance with a further embodiment of the invention.

The arrangement shown in FIG. 3 has a prop casing 44 and two hydraulically operated pit props 45 arranged at both sides adjacent to the prop casing 44. The pit props 45 are located diametrically opposite to one another relative to a longitudinal axis 46 of the prop casing 44.

The prop casing 44 has a lower prop casing portion 47 and an upper prop casing 48 which is axially telescopable in the lower casing portion. Both casing 47 and 48 are open at their ends. The lower prop casing 47 is composed of two semi-circular sections 49 and 50 which are connected and can be locked with one another via hinge members 51. The upper prop casing portion 48 is also composed of two semi-circular sections 52 and 53 which are pivotally connectiable and lockable with one another in the region of the roof via hinge members 54. The upper prop casing portion 48 has an upper annular collar 58 and a further annular collar 56 spaced from the annular collar 55 so as to form a circumferential groove 57. A collar 20 fits in the annular groove 57. This construction corresponds to that shown in FIGS. 1 and 2. The collar 20 is not shown in FIG. 3 in order to improve visibility of the arrangement.

The end annular collar 55 has a greater diameter than the diameter of the annular collar 56. It has at its lower side 58 two diametrically opposite recesses 59 in which piston rods 60 of two cylinder-and-piston units 61 engage. A cylinder 62 of the cylinder-and-piston unit 61 is mounted on the pit prop 45 via collars 63. The piston rods 60 is retained under the action of spring elements 64 and the cylinders 62. The spring element 64 can be formed by helical pressure springs.

The pit props 45 extend with their extensible longitudinal portions 65 toward the sole 2, whereas the non-extensible longitudinal portions 66 extend toward the roof 1. The free ends of the extensible longitudinal portions 65 support in recesses 67 of a bottom plate 68. The bottom plate 68 is provided with a central through-going opening 69 through which the lower prop casing portion 47 extends.

Figure 4:
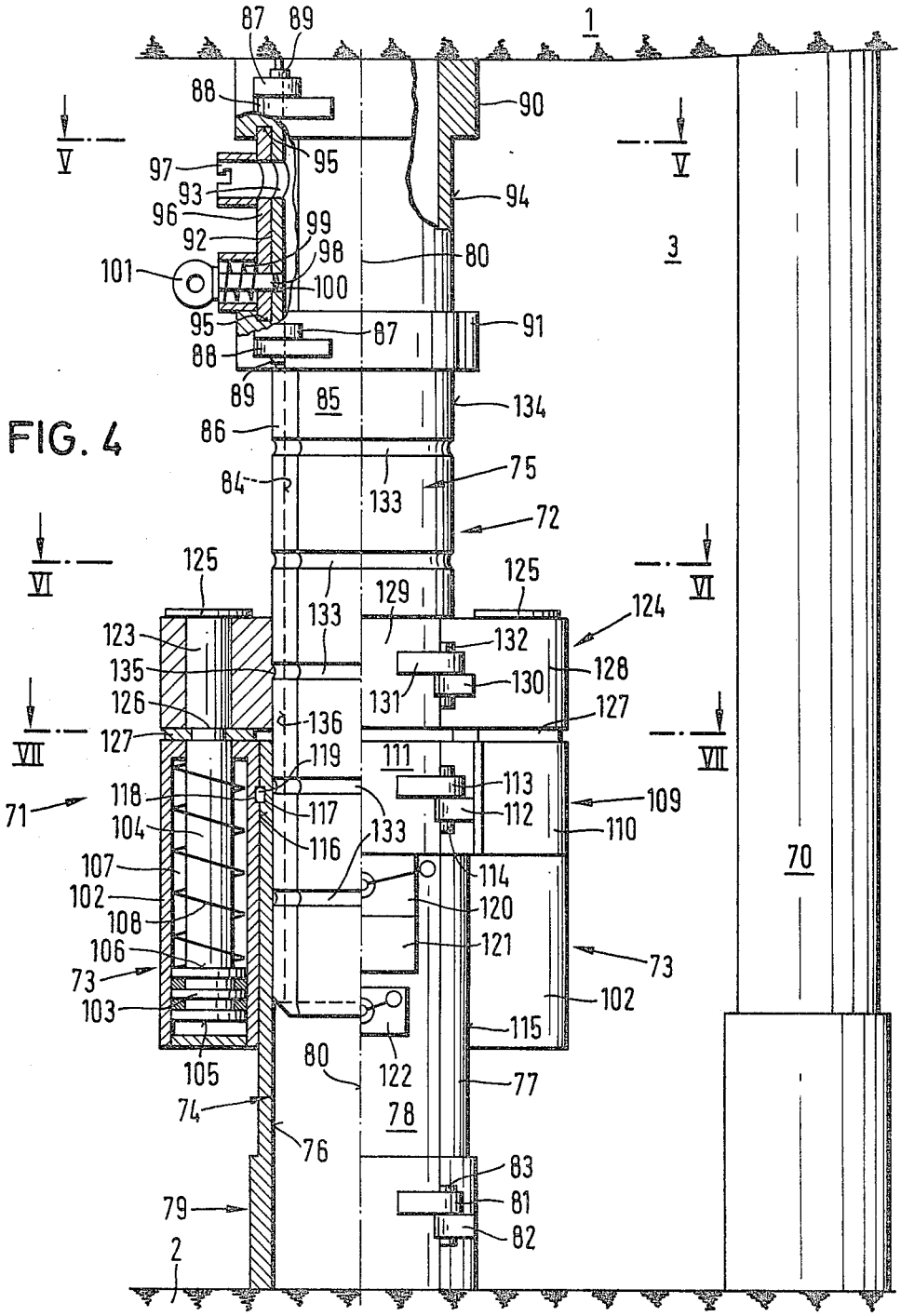
FIG. 4 is a partially sectioned side view of an arrangement for erecting a columnar supporting element in accordance with a third embodiment of the invention, and a supporting element erected by the arrangement.
Figure 5:
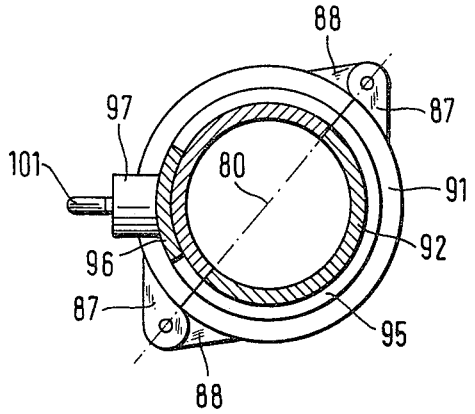
FIGS. 5–7 are views showing various horizontal sections of the arrangement of FIG. 4, taken along the lines V—V, VI—VI and VII—VII.

In FIG. 4 reference numeral 1 identifies the roof and reference numeral 2 identifies the sole of the mine gallery with a supporting column 17 of concrete built in the same. 71 is an arrangement for erecting the supporting column 7. It is composed of a multi-part prop casing 72 and two cylinder-and-piston units 73 which perform the function of telescoping the prop casing 72 and tightening the same between the roof 1 and the sole 2 with generation of an active supporting force.

The prop casing 72 is composed of a lower prop casing portion 74 and an upper prop casing portion 75 which is actually displaceable in the lower prop casing portion. The lower prop casing portion 74 is composed of two semi-circular sections 77 and 78 which are open at their ends, have cylindrical inner surfaces 76 and are pivotally connectible with one another. The semi-circular sections 77 and 78 have a reinforced end section 79 adjacent to the sole, and two bearing ear pairs 81 and 82 arranged in the end section 79. Pins 83 extend axially through the bearing ear pairs 81 and 82. The pins 83 form both a working axle and a pivot axle in dependence upon which pin 83 is withdrawn from the bearing ears 81 and 82 during pivoting of the lower casing portion 74.

The upper prop casing portion 75 is composed of two semi-circular sections 85 and 86 which have cylindrical inner surfaces 84 and are pivotally connectible with one another. The semi-circular sections 85 and 86 also have bearing ear pairs 87 and 88 through which pins 89 vertically extend. The bearing ears 87 and 88 are welded onto annular collars 90 and 91 which are provided in roof-side and section of the upper prop casing portion 75.

A filling opening 93 for concrete is provided between both annular collars 90 and 91 in a wall 92 of the upper prop casing portion 75. A closure 96 is arranged on a circumferential surface 94 of the upper prop casing portion 75 between the annular collars 90 and 91 and moves in grooves 95 of the latter. During the filling step, the closure 96 is brought to a location in front of the filling opening 93 so that a filling pipe 97 provided on the closure 96 is in coaxial registry with the filling opening 93. For arresting the closure in this position, a pin 98 is provided which is engaged in a recess 100 of the wall 92 of the upper prop casing portion 75 under the action of a helical pressure spring 99.

When the filling step terminates, the pin 98 is withdrawn from the recess 100 with the aid of an ear-like handle 101 and thereafter the closure 96 is rotated about a longitudinal axis 80 in the grooves 95 of the annular collars 90 and 91 until the filling opening 93 is closed by a non-cut wall section of the closure 96. The pin 98 slides over the outer circumference 94 of the upper prop casing portion 75.

Figure 7:
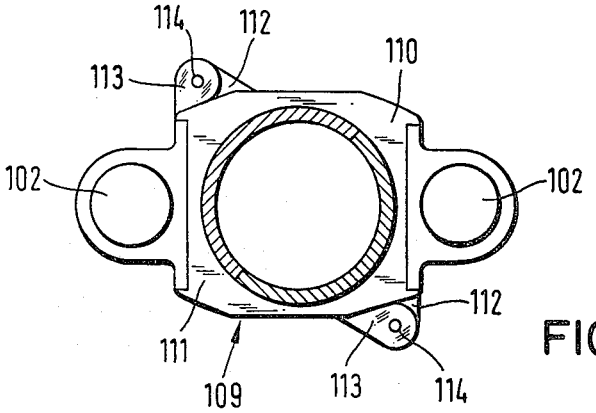

The telescopicing of both prop casing portions 74 and 75 is performed by the above-mentioned hydraulically actuated cylinder-and-piston until 73. The cylinder-and-piston unit 73 has a cylinder 102 in which a sealed piston 103 with a piston rod 104 move in longitudinal direction. The piston rod 103 is actuated at its front face 103 hydraulically and at its annular face 106 by a helical pressure spring 108 arranged in a piston rod chamber 107 and surrounding the piston rod 104. The cylinders 102 of the cylinder-and-piston units 73, as can be seen from FIG. 7, are arranged in a two-part glasses-like hinge member 109. Both parts 110 and 111 of the hinge member 109 are pivotally connected with one another by bearing ears 112 and 113 and pins 113 insertable in the latter. In order to axially secure the hinge member 109, grooves 117 and 118 are provided in an outer surface 115 of the lower prop casing portion 74 and an inner surface 116 of the hinge member 109. When the hinge member 108 is arranged on the lower prop casing portion 74, an elastic spring 112 fitting to the cross-section of the grooves 117 and 118 extends through the latter.

Figure 6:
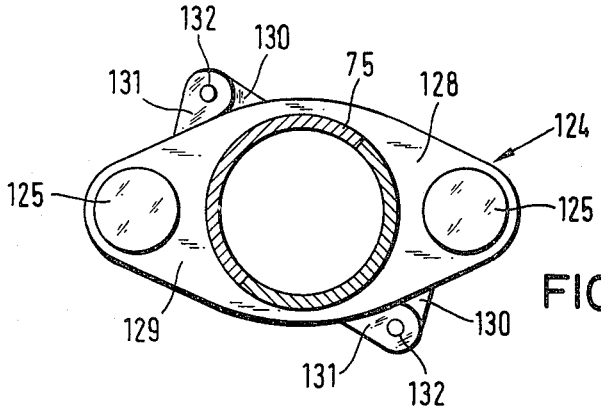

As can be further seen in FIG. 4, the hinge member 110 serves simultaneously as a support for a hand pump 120 and a supply container 121 for a hydraulic working medium as well as for a control device 122 of the cylinder-and-piston unit 73. Free ends 123 of the piston rods 104 of the cylinder-and-piston units 73 extend in a similar two-part hinge member 124 (FIG. 6) which is clamped on the upper prop casing portion 75. The piston rods 104 are arranged in the hinge member 124 in the draw-resistant and pressure-resistant manner. This purpose is attained by an abutment plate 126 provided at an end side of the piston rod 104 and an abutment disk 137 inserted in an annular groove 126 of the piston rod 104.

Both parts 128 and 129 of the hinge member 124 are connected to one another via bearing ear pairs 130 and 131 and pins 132 which vertically extend through the latter. Axle securing on the upper prop casing portion 75 is attained by circumferential grooves 133 in an outer surface 134 of the upper prop casing portion 75, as well as by an annular bead 135 which extends radially inwardly from an inner surface 136 of the hinge member 124. The circumferential grooves 133 in the upper prop casing portion 75 are arranged at such a distance from one another that when the upper prop casing portion 75 is pulled out, the hinge member 124 is secured in this circumferential groove 133. This results in that the hinge member 124 can be brought as close as possible to the hinge member 109 which carries the cylinder 102 so as to utilize the stroke of the cylinder-and-piston units 73 as long as possible.

It will be understood that each of the elements described above, or two or more together, may also find a useful application in other types of constructions differing from the types described above.

While the invention has been illustrated and described as embodied in an arrangement for erecting columnar support of hardenable material in an underground excavation, it is not intended to be limited to the details shown, since various modification and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for erecting a columnar supporting element of a hardenable flowable material, for a roof of an underground excavation such as a mine, the arrangement comprising a hollow casing for filling a hardenable flowable material to be hardened therein so as to form a columnar supporting element, said casing having a longitudinal axis and including upper and lower coaxial casing portions which are tubular and telescopable in all axial directions, each of said casing portions being composed of two open-ended semi-circular sections, said upper casing portion having an annular collar provided with a bracket;

a pit prop extending between a roof and the floor of the excavation adjacent to said casing and having a shoulder and an axially displaceable sleeve engaging with said bracket;

means for holding said upper casing portion in contact with a roof of an underground excavation, said holding means being arranged adjacent to said casing and longitudinally variable, said holding means being resiliently yieldable and formed as a helical pressure spring located between said shoulder and said sleeve of said pit prop;

means for connecting the semi-circular sections of at least said lower casing portion with one another pivotally about a longitudinal pivot axis which is parallel to said longitudinal axis of said casing, and locking the same with one another.

2. An arrangement as defined in claim 1, wherein said bracket has a bracket section which engages with said annular collar of said upper casing portion and is formed as a gripping clamp.

3. An arrangement for erecting a columnar supporting element of a hardenable flowable material, for a roof of an underground excavation such as a mine, the arrangement comprising a hollow casing for filling a hardenable flowable material to be hardened therein so as to form a columnar supporting element, said casing having a longitudinal axis and including upper and lower coaxial casing portions which are tubular and telescopable in all axial directions, each of said casing portions being composed of two open-ended semi-circular sections, said upper casing portion having an annular collar;

two pit props located diametrically opposite relative to said casing and extending between a floor and the roof of the excavation;

means for holding said upper casing portion in contact with a roof of an underground excavation, said holding means being arranged adjacent to said casing and longitudinally variable, said holding means including two cylinder-and-piston units each provided with a mechanical spring and having a cylinder mounted on a respective one of said pit props, and a piston cooperating with said upper casing portion, said pistons of said cylinder-and-piston units being arranged to abut against said annular collar of said upper casing portion;

a bottom plate arranged to be placed on the floor of the excavation and having a central opening, said pit props supporting on said bottom plate, and said lower casing portion extending through said central opening of said bottom plate; and means for connecting the semi-circular sections of at least said lower casing portion with one another pivotally about a longitudinal pivot axis which is parallel to said longitudinal axis of said casing, and locking the same with one another.

4. An arrangement for erecting a columnar supporting element of a hardenable flowable material, for a roof of an underground excavation such as a mine, the arrangement comprising a hollow casing for filling a hardenable flowable material to be hardened therein so as to form a columnar supporting element, said casing having a longitudinal axis and including upper and lower coaxial casing portions which are tubular and telescopable in an axial direction, each of said casing portions being composed of two open-ended semi-circular sections, said casing being formed reusable and withstanding a rock pressure in the underground excavation so that a roof of the underground excavation is reliably supported during hardening of the flowable hardenable material;

means for holding said upper casing portion in contact with a roof of an underground excavation and applying supporting force to the roof of the underground excavation so as to support the roof during hardening of the flowable hardenable material, said holding means being arranged adjacent to said casing and longitudinally variable;

means for connecting the semi-circular sections of at least said lower casing portion with one another pivotally about a longitudinal pivot axis wich is parallel to said longitudinal axis of said casing, and locking the same with one another.

5. An arrangement as defined in claim 4, wherein said casing is composed of such a material that said material, in combination with said upper and lower casing portions composed of said sections, render said casing reusable and withstanding the rock pressure.

6. An arrangement as defined in claim 4, and further comprising a pit prop extending between a roof and the floor of the excavation adjacent to said casing, said holding means being resiliently yieldable and supported on said pit prop.

7. An arrangement as defined in claim 6, wherein said holding means is formed as a helical pressure spring.

8. An arrangement as defined in claim 4; and further comprising two pit props located diametrically opposite relative to said casing and extending between a floor and the roof of the excavation, said holding means including two cylinder-and-piston units each provided with a mechanical spring and having a cylinder mounted on a respective one of said pit props, and a piston cooperating with said upper casing portion.

9. An arrangement as defined in claim 8, wherein said upper casing portion has an annular collar, said pistons of said cylinder-and-piston units being arranged to abut against said annular collar of said upper casing portion.

10. An arrangement as defined in claim 6, wherein said pit prop has an extensible elongated portion extending toward a floor of the excavation.

11. An arrangement as defined in claim 4, wherein said upper casing portion has an upper end, an upper radially extending collar on said upper end, and a lower radially extending collar downwardly spaced from said upper collar, said upper casing portion having a filling opening arranged for passing the hardenable flowable material and located between said collars.

12. An arrangement as defined in claim 11, and further comprising a ring which releasably fits between said collar and has a filling pipe, said ring being rotatable about said longitudinal axis of said casing between a filling position in which said filling pipe coincides with said filling opening and a closing position in which said ring closes said filling opening.

13. An arrangement as defined in claim 12; and further comprising means for arresting said spring of said upper portion of said housing.

14. An arrangement as defined in claim 4, wherein the semi-circular sections of at least said lower casing portion are provided with hinge members.

15. An arrangement as defined in claim 4; and further comprising means for connecting the semi-circular sections of said upper casing portion with one another pivotally about a pivot axis which is parallel to said axis of said prop casing and locking the same with one another, said holding means including two hydraulically operated cylinder-and-piston units located diametrically opposite to one another relative to said longitudinal axis of said prop casing, each of said cylinder-and-piston units including a cylinder hingedly connectable with said lower casing portion and a piston rod clamped on said upper casing portion.

16. An arrangement as defined in claim 14; and further comprising means for hingedly connecting said cylinders with said lower casing portion and including hinge collars.

17. An arrangement as defined in claim 15, wherein each of said connecting and locking means for the semi-circular sections of a respective one of said casing portions includes an axle which defines a respective one of said pivot axis extending parallel to said longitudinal axis of said prop casing, and a locking axle which also extends parallel to said longitudinal axis of said prop casing and arranged to lock the semi-circular sections of a respective one of said casing portions with one another.

18. An arrangement as defined in claim 16, wherein said hinge collars are glasses-shaped and receive said cylinders; and further comprising further glasses-shaped hinge collars receiving said piston rods.

19. An arrangement as defined in claim 18; and further comprising means for securing said hinge collars in a longitudinal direction of said prop casing, said securing means including a first groove formed in each of said flange collars, a second groove formed in said prop casing, and a spring accommodated in both grooves.

20. An arrangement as defined in claim 18, wherein said piston rods of said cylinder-and-piston units are arranged in draw-resistant and pressure-resistant manner in said hinge collars.

21. An arrangement as defined in claim 4, wherein said upper casing portion has an outer surface profided with a plurality of circumferential grooves which are spaced from one another in an axial direction.

22. An arrangement as defined in claim 15, wherein each of said cylinder-and-piston units has a piston and a cylindrical chamber formed at the side of a respective one of said piston rods, said holding means further including a helical pressure spring arranged in the cylindrical chamber of each of said cylinder-and-piston units and acting upon a respective one of said pistons.

23. An arrangement as defined in claim 16, wherein said holding means further includes a supply container and a pump for hydraulic working medium, and control means for said cylinder-and-piston units, said supply container with said pump and said control means being formed as blocks flanged on said hinge collars.

24. An arrangement as defined in claim 15; wherein said upper casing portion has an end part located adjacent to the roof of the underground excavation and provided with two radially extending annular collars spaced from one another in a vertical direction, and a filling opening arranged between said annular collars for passing the hardenable flowable material; and further comprising a rotary and arrestable closing member provided with a filling pipe and rotatable between filling and closing position.

25. An arrangement as defined in claim 24; and further comprising a spring-actuated pin arranged to arrest said closing member in said filling position.

26. An arrangement as defined in claim 4, wherein said prop casing is metallic.

27. An arrangement as defined in claim 26, wherein said prop casing is constituted of steel.

28. An arrangement as defined in claim 26, wherein said prop casing is constituted of a steel alloy.

29. An arrangement as defined in claim 26, wherein said prop casing is constituted of a metal alloy.

* * * * *